United States Patent [19]

Iijima et al.

[11] 4,443,315

[45] Apr. 17, 1984

[54] FINGER TYPE ELECTROLYTIC CELL FOR THE ELECTROLYSIS OF AN AQUEOUS ALKALI METAL CHLORIDE SOLUTION

[75] Inventors: Tokuzo Iijima, Kobe; Yasushi Samejima, Kakogawa; Toshiji Kano, Kobe, all of Japan

[73] Assignee: Kanegafuchi Kagaku Kogyo Kabushiki Kaisha, Osaka, Japan

[21] Appl. No.: 256,576

[22] Filed: Apr. 22, 1981

[30] Foreign Application Priority Data

Jul. 3, 1980 [JP] Japan ..... 55-94269[U]
Jul. 3, 1980 [JP] Japan ..... 55-94268[U]

[51] Int. Cl.[3] ..... C25B 9/00
[52] U.S. Cl. ..... 204/253; 204/279
[58] Field of Search ..... 204/252–258, 204/263–266, 279

[56] References Cited

U.S. PATENT DOCUMENTS

| | | | |
|---|---|---|---|
| 3,956,097 | 5/1976 | de Nora et al. | 204/252 |
| 4,039,420 | 8/1977 | Nawrot | 204/279 X |
| 4,136,004 | 1/1979 | Kamarian et al. | 204/266 X |
| 4,248,689 | 2/1981 | Cunningham | 204/252 |
| 4,271,004 | 6/1981 | Cunningham et al. | 204/266 |
| 4,278,523 | 7/1981 | Byrd et al. | 204/252 |
| 4,283,263 | 8/1981 | Mirabelli | 204/279 X |

*Primary Examiner*—Donald R. Valentine
*Attorney, Agent, or Firm*—Armstrong, Nikaido, Marmelstein & Kubovcik

[57] ABSTRACT

A finger type electrolytic cell providing a cation exchange membrane for electrolysing an aqueous alkali metal chloride solution is disclosed. The cell is comprised of a cell top cover whose surface is coated with a chlorine-resistant material containing no polymetallic ions, and further a blanket which is made of or covered with said material, so that no hindrance resulting from polymetallic ions occurs.

4 Claims, 4 Drawing Figures

FINGER TYPE ELECTROLYTIC CELL FOR THE ELECTROLYSIS OF AN AQUEOUS ALKALI METAL CHLORIDE SOLUTION

DETAILED DESCRIPTION OF THE INVENTION

The present invention is directed to an improved electrolytic cell for the electrolysis of an aqueous alkali metal chloride solution, which cell is free from dissolution of polymetallic ions into anodic solution.

Most cell top covers of electrolytic cells are made of fibre reinforced plastics (FRP). As a fibre for reinforcement, a glassfibre is the most popular for its good properties and further carbon fibre, an organic polymeric fibre such as polyethylene, polypropylene and fluorinated polymers.

When a glassfibre reinforced polymer, for example, polyester polymer is employed as a cell top cover material, the cell top cover comes in contact with anodic solution or chlorine gas in gaseous phase during the course of electrolysis so that polymetallic ions such as calcium ion contained in glass dissolve into the anodic solution. These polymetallic ions deposit onto an ion exchange membrane to thus raise cell voltage, thereby hindering normal operation.

It is an object of the present invention to provide a finger type electrolytic cell which is free from hindrance due to polymetallic ions dissolved into an anodic solution.

Another object of the present invention is to provide a finger type electrolytic cell which prevents leakage of anodic solution from a mounted portion of anodes at a bottom plate of the cell.

The foregoing objects are attained by the present electrolytic cell comprises a plurality of anodes mounted at the bottom plate of the cell, a cathode box providing a cathode between adjacent anodes, cation exchange membranes posioned between adjacent anodes and cathodes by which the cell is partitioned into anode compartments and cathode compartments, and a cell top cover whose inside surface portion is made of a chlorine-resistant material containing no polymetallic ions.

As finger type electrolytic cells used in the present invention, there are included not only a finger type construction cell such as that described at page 93, *Chlorine Its Manufacture, Properties and Uses,* edited by J. S. Scone, issued by Reinhold Publishing Corporation, New York, 1962, but also a flattened tube type construction cell. Nowadays, the flattened tube type construction is also generally referred to as a finger type electrolytic cell.

As alkali metals herein, there are included sodium, potassium and the like.

The cell top cover comprises a laminated structure of thin multilayer sheets made of FRP. It is one of the most preferable embodiment in the present invention to coat the inside surface of the cell top cover with a chlorine-resistant material containing no polymetallic ions, more particularly, to employ a chlorine-resistant material containing no polymetallic ions for the inside first layer (surface mat; SM) alone or further second or third mat (Chopped strand mat; CSM), at most.

The whole thickness of the anti-corrosive portion of the cell top cover is preferred in the range of from about 0.3 to about 3 mm and the inside surface mat is preferably 0.3 mm or more, the second chopped strand mat CSM is preferably 1 mm or more, and the third chopped strand mat is also preferably 1 mm or more.

As an anti-corrosive material, any known anti-corrosive material may be suitably employed, provided that it possesses a chlorine-resistant property and contains no polymetallic ions. Examples are an anti-corrosive plastic such as a heat-resistant polyvinyl chloride resin, a fluorocarbon polymer such as tetrafluoroethylene polymer, an anti-corrosive metal such as titanium and carbon and so on.

In the electrolysis of an aqueous alkali metal chloride solution using an electrolytic cell as stated above, it is normal that a rubber blanket is located on the surface of a bottom plate of the cell for the purpose of insulation and protection of the bottom plate. The rubber blanket, however, contains polymetallic ions such as calcium and magnesium and these ions dissolve into anodic solution during the electrolysis. In an ion exchange membrane process, these polymetallic ions deposited on the membrane cause an increase in cell voltage and interfare with the operation, whereas in a diaphragm process no particular problems are raised even when these ions deposit the diaphragm. It has been found out by the inventors that the foregoing problem is eliminated by positioning a blanket whose surface is made of a chlorine-resistant material containing no polymetallic ions at the bottom plate of the anode compartments. As a blanket material, any known chlorine-resistant material containing no polymetallic ions may be used, for example, an anti-corrosive plastic such as a heat-resistant polyvinyl chloride resin, a fluorocarbon polymer such as tetrafluoroethylene polymer, an anti-corrosive metal such as titanium and so on. The blanket made of these materials may be used as a substitute for a rubber blanket or may be located on the surface of the rubber blanket. In the latter case, the blanket of these anti-corrosive materials preferably has the thickness between about 100 and about 300 microns.

Meanwhile, in installing anodes to the blanket whose surface is covered with a chlorine-resistant material containing no polymetallic ions, there often arises a problem that anodic solution is apt to leak even when anode ribs are firmly secured to the blanket. Accordingly there is a strong need for an electrolytic cell which permits neither dissolution of polymetallic ions nor leakage of anodic solution.

The foregoing need is satisfied by an electrolytic cell in which elastic bodies having a rubber elasticity is positioned at the blanket around holes in which anodes are embedded, then anode ribs, the elastic bodies, the blanket and the bottom plate are tightened firmly and sealed.

As the elastic body possessing a rubber elasticity which is located around the holes provided on the blanket, there are included an ordinary rubber, a synthetic rubber, urethane rubber and any known material possessing elasticity.

The cation exchange membrane used in the present invention includes a fluorinated membrane conveying cation exchange groups such as a perfluorosulfonic acid perfluorohydrocarbon polymer membrane, which is sold under the trademark "Nafion" by E. I. Du Pont de Nemours & Company. The perfluorosulfonic acid perfluorohydrocarbon polymer membrane has the following structure;

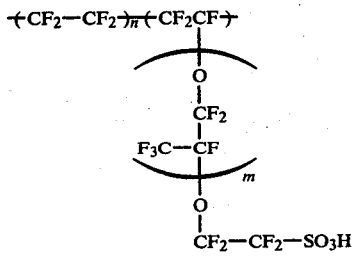

wherein the concentration of exchange groups are described as about 1,100 to 1,500 g of dry membrane per an equivalent of $SO_3-$ exchange groups. Such cation exchange membranes may be also employed as having weak acid groups of carboxylic acid, phosphoric acid and the like, singly or in combination of sulfonic acid aforesaid.

The cation exchange membrane had best be installed to a finger type cell according to the manner disclosed in Japanese Patent Publication (non-examined) No. 100,952/1979.

The cathode material used suitably in the present invention is an electroconductive material resistant to cathodic solution such as iron, steel, nickel or an alloy thereof. The shape of the cathode is, for example, an expanded metal mesh, a metal plate having perforations or slits, rods or the like.

The anode material used suitably in the present invention is an anodic solution-resistant valve metal such as titanium, tantalum, zirconium, tungsten or the like. A valve metal serving as the anode includes platinum group metals, mixed oxides of valve metals and platinum group metals or the like. The anode may be in various shapes such as an expanded metal mesh, a metal plate having perforations or slits, rods or the like.

Figure 1:
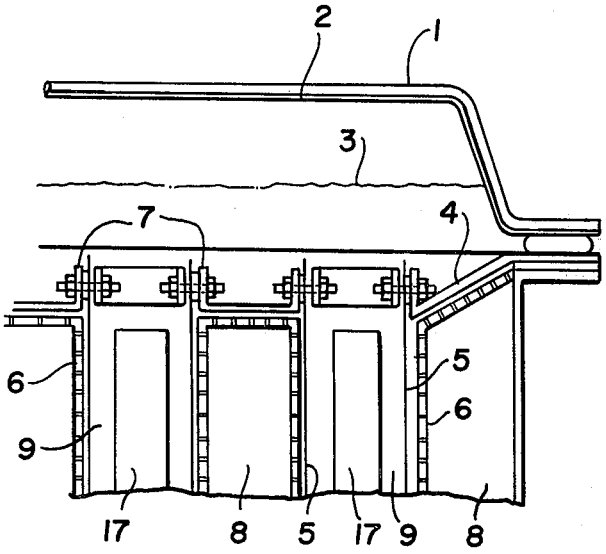
FIG. 1 is a partial vertical sectional view of an electrolytic cell which comprises a cathode box to which cation exchange membranes are installed, anodes and a cell top cover particularly devised.

Referring now to FIG. 1, an electrolytic cell comprises a plurality of anodes 17, a cathode box providing a cathode 6 between adjacent anodes 17, cation exchange membranes 5 positioned between adjacent anodes 17 and cathodes 6, the membranes 5 being positioned substantially parallel to the vertical surface of the cathodes 6 and then secured by, for example, bolts to right-angled collars 7 of upper and lower membrane installation frames 4 (lower frame is not shown) positioned so as to cover the upper and lower horizontal surfaces of the cathodes 6 not opposing the anodes 17, by which membranes the cell is partitioned into anode compartments 9 and cathode compartments 8, and a cell top cover 1 of which surface 2 is made of a chlorine-resistant material containing no polymetallic ions. The cell is filled with anodic solution (Sodium chloride solution) up to the level 3.

Figure 2:
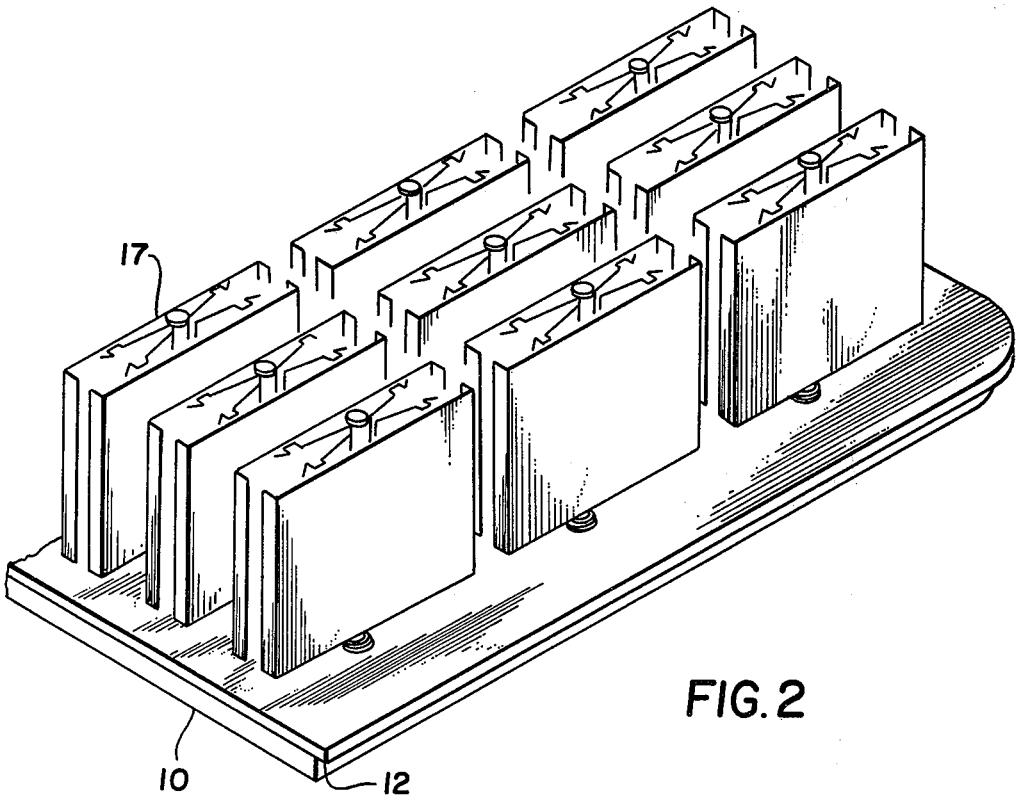
FIG. 2 is a perspective view of anodes mounted at a bottom plate.

In FIG. 2, a blanket 12 made of a chlorine-resistant material containing no polymetallic ions is located at a bottom plate 10. An expandable dimensionally stable anode 17 comprising two working surfaces and a spring interposed therebetween is embedded in the bottom plate 10.

Figure 3:
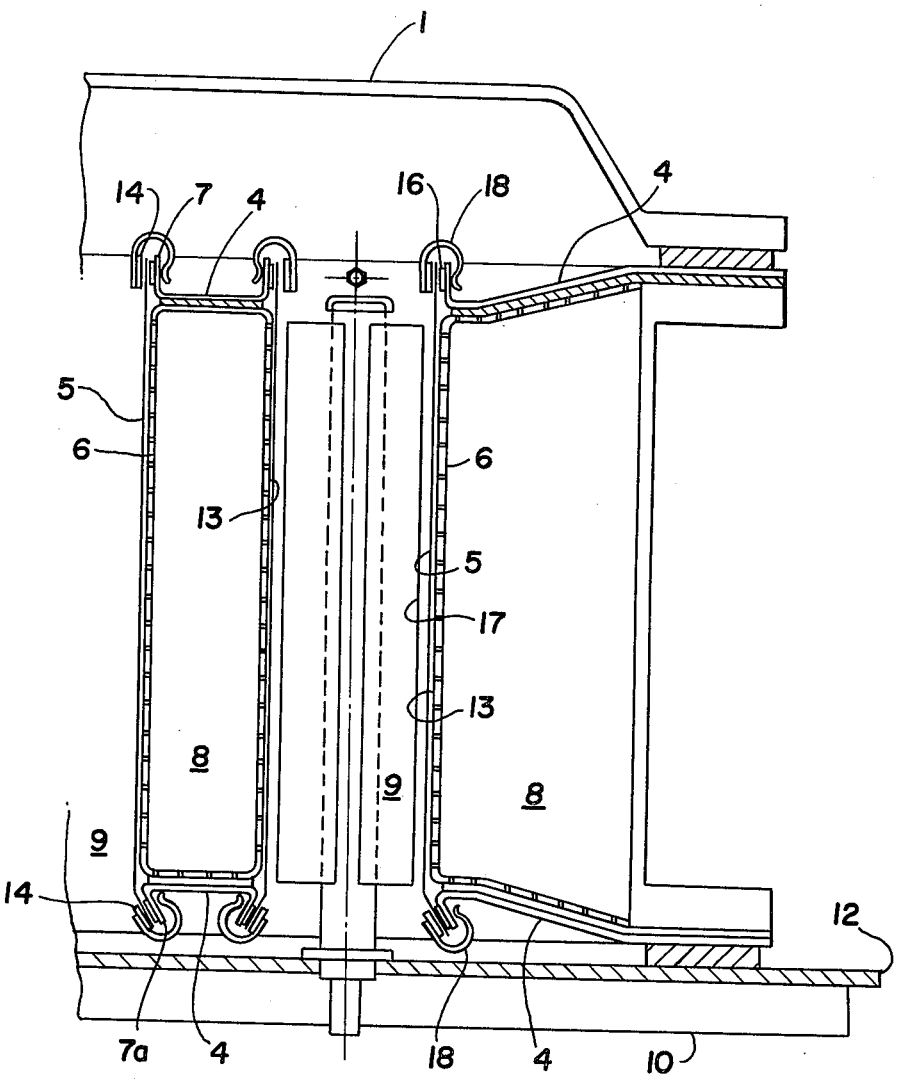
FIG. 3 is a partial vertical sectional view illustrating another embodiment of an electrolytic cell which comprises a cathode box to which cation exchange membranes are installed, anodes and a cell top cover.

In FIG. 3, cylindrical membranes 5 are positioned substantially parallel to and along the vertical surfaces 13 of the cathodes 6 and installed to upper and lower membrane installation frames 4, the former having right-angled collars 7 and the latter having acute-angled collars *7a* to the flat portion of the installation frame. The end portions of the membranes 5 are located respectively at and along the right-angled collars 7 or the acute-angled collars *7a*, pressing plates 14 are placed on the end portiones of the membranes 5, packings 16 are interposed between the end portions of the membranes 5 and the right-angled-collars 7 or the acute-angled collars *7a*, then these are tightened up and sealed by the use of clips 18.

Figure 4:
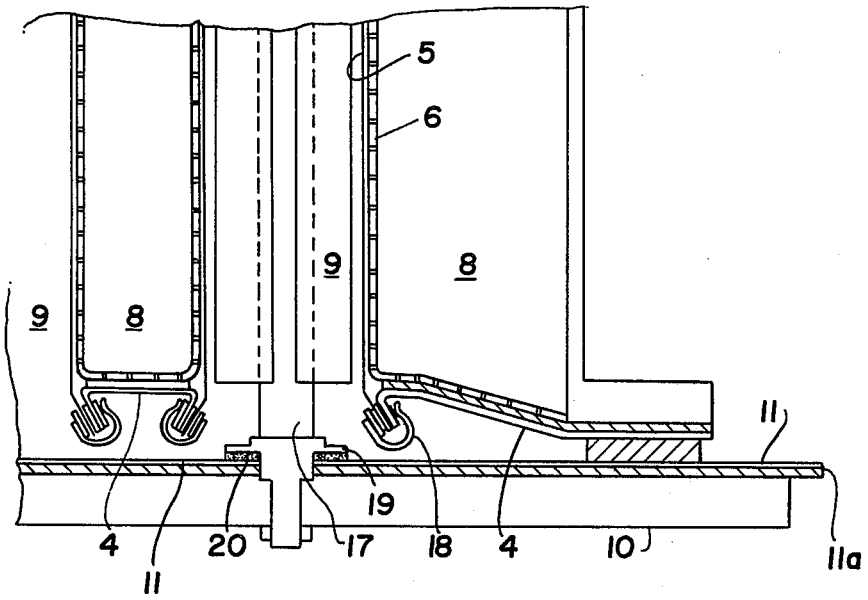
FIG. 4 is an enlarged partial view of illustrating anodes mounted at a bottom plate.

In FIG. 4, on a bottom plate 10 is a rubber blanket 11*a* located and further a blanket 11 made of a chlorine-resistant material containing no polymetallic ions is placed on the rubber blanket 11*a*. An expandable dimensionally stable anode 17 comprising two working surfaces and a spring interposed therebetween is embedded, through the blanket 11, the rubber blanket 11*a* and the bottom plate 10, at the bottom plate 10, in which an elastic body 20 is interposed between an anode rib 19 and the chlorine-resistant blanket 11.

The electrolytic cell of the present invention is quite free from dissolution of polymetallic ions into an anodic solution from a cell top cover or a blanket, maintains cell voltage constant during the course of the electrolysis, enables low energy consumption and produces a high pure alkali metal hydroxide with substantially no content of impurities. Moreover, the present invention provides a superior electrolytic cell which prevents leakage of an anodic solution from the cell.

What we claim is

1. A finger type electrolytic cell for the electrolysis of an aqueous alkali metal chloride solution which cell comprises a plurality of anodes mounted at the bottom plate of the cell, a cathode box providing a cathode between adjacent anodes, cation exchange membranes positioned between adjacent anodes and cathodes by which the cell is partitioned into anode compartments and cathode compartments, and a cell top cover whose inside surface portion is laminated by thin multilayer sheets of a fibre reinforced plastic and is made of a chlorine-resistant material containing no polymetallic ions.

2. The cell of claim 1, wherein a material of the body of the cell top cover is a fibre reinforced plastic.

3. A finger type electrolytic cell for the electrolysis of an aqueous alkali metal chloride solution which cell comprises a plurality of anodes mounted at the bottom plate of the cell, a cathode box providing a cathode between adjacent anodes, cation exchange membranes positioned between adjacent anodes and cathodes by which the cell is partitioned into anode compartments and cathode compartments, and a cell top cover which comprises a laminated structure of thin multilayer sheets of a fibre reinforced plastic, and at least the first inside surface layer sheet of which is made of a chlorine-resistant material containing no polymetallic ions.

4. The cell of claim 3 wherein the layer sheet substituted with a chlorine-resistant material is up to the third layer sheet from the inside surface layer.

* * * * *